US007622871B2

(12) United States Patent
Awalt et al.

(10) Patent No.: US 7,622,871 B2
(45) Date of Patent: Nov. 24, 2009

(54) LIGHT EMITTING DIODE DRIVER CIRCUIT WITH SHUNT SWITCH

(75) Inventors: Thruston Awalt, Los Gatos, CA (US); Hardik Dineshchandra Patel, Milpitas, CA (US)

(73) Assignee: Micrel, Incorporated, San Jose, CA (US)

( * ) Notice: Subject to any disclaimer, the term of this patent is extended or adjusted under 35 U.S.C. 154(b) by 312 days.

(21) Appl. No.: 11/865,695

(22) Filed: Oct. 1, 2007

(65) Prior Publication Data

US 2009/0085490 A1 Apr. 2, 2009

(51) Int. Cl.
*H05B 37/02* (2006.01)

(52) U.S. Cl. ..... 315/291; 315/307

(58) Field of Classification Search ..... 315/83, 315/209 R, 224, 291, 294, 307; 345/82, 345/83

See application file for complete search history.

(56) References Cited

U.S. PATENT DOCUMENTS 6,586,890 B2 * 7/2003 Min et al. ..... 315/224
6,867,757 B1 * 3/2005 Nakamura ..... 345/83
7,317,403 B2 * 1/2008 Grootes et al. ..... 340/815.45
2007/0229001 A1 * 10/2007 McIntosh et al. ..... 315/307

* cited by examiner

*Primary Examiner*—Douglas W Owens
*Assistant Examiner*—Jimmy T Vu
(74) *Attorney, Agent, or Firm*—Bever, Hoffman & Harms, LLP; Patrick T. Bever

(57) ABSTRACT

A LED driver circuit avoids undesirable light generated by a LED due to leakage current by shunting the output terminal to the feedback terminal during periods when it is desired that the LED remain turned off. The shunting operation is achieved by providing a switch (e.g., a FET) that is connected between the output and feedback terminals of the LED, and is controlled by the user supplied reference signal. During active operation (i.e., when the user supplied reference signal is "enabled" and the LED is lit), the switch remains open, allowing the driver circuit to generate the desired driving voltage across the LED. During inactive periods (i.e., when the user supplied reference signal is "disabled" and the LED is intended to be off), the switch is closed, which couples the output and feedback terminals to generate an essentially zero voltage drop across the LED.

11 Claims, 3 Drawing Sheets

LIGHT EMITTING DIODE DRIVER CIRCUIT WITH SHUNT SWITCH

FIELD OF THE INVENTION

The technology described herein is generally related to the field of integrated circuits and, more particularly, to driver circuits for light emitting diodes ("LEDs").

BACKGROUND OF THE INVENTION

LEDs are known to act as a source of emitted light for a wide variety of applications. LEDs are known to provide many advantages over incandescent and fluorescent illumination because of their long operating life, high efficiency, lightweight, and low profile.

FIG. 4 is a schematic diagram illustrating a conventional LED display including an LED driver circuit 50 for driving an LED chain 52 made up of serial connected LEDs 53-1 to 53-N. LED driver circuit 50 includes a DC-DC boost converter 51 that is utilized in conjunction with a passive inductor $L_{EXT}$ and a passive discharge capacitor $C_{EXT}$. DC-DC boost converter 51 includes a comparator (operational amplifier) 55, a pulse width modulator ("PWM") 58, an internal capacitor $C_{INT}$, an npn bipolar transistor $T_1$ and a zener diode $S_1$. An external voltage (VIN) is supplied, for example, from a battery, to the anode of diode $S_1$ and to the collector of transistor $T_1$ by way of inductor $L_{EXT}$. The voltage level at the output node 54, which is connected to a first end of the LED chain 52, is established by a user supplied reference voltage "$V_{REF}$" applied to the input terminal (node 57) that is connected to the inverting input terminal of comparator 105, also sometimes referred to in the art as the "error amplifier". The second end of LED chain 52 is connected to the non-inverting input terminal of comparator 55, which is also connected to ground by way of an appropriately sized resistor "$R_{EXT}$" 56. The output voltage at node 54 adjusts until the loop through boost converter 51 controls the current passing through LED chain 52 such that the current is defined as $I=V_{REF}/R_{EXT}$, where $V_{REF}$ is a regulated voltage powered from $V_{IN}$. Light output from LED chain 52 is proportional to the current generated by LED driver 50, and can therefore be selectively increased by way of increasing the current generated by LED driver circuit 50. LED driver circuits similar to those shown in FIG. 4 are used in commercial products such as the Model 2287 integrated circuit manufactured by the assignee of the present application, that drive LED chains such that current feedback substantially constantly adjusts the power to the LED chain (see also, e.g., Min et al., U.S. Pat. No. 6,586,890, which is incorporated herein by reference in its entirety).

LEDs have improved in light emitting efficiency (i.e., conversion of electricity to light) by several orders of magnitude over the past decade. Newer LEDs provide an advantage over early LEDs in that, when provided sufficient power, they emit enough light to be seen in direct daylight. In contrast, early LEDs (i.e., those produced in the mid to late 1990s) appeared to be OFF when operated in direct daylight, no matter what level of current was applied to the LED. The efficiency improvement of newer LEDs has made possible their use in efficient outdoor video billboards.

However, with the increased light emitting efficiency of current LEDs, a new problem arises in that they can emit sufficient light to be visible with only a few microamps of current flowing through them. This low on-current can have negative repercussions in real life applications if the driver circuit driving the LEDs (e.g., driver circuit 50, described above with reference to FIG. 4) has any significant level of leakage current. For example, in stadium video displays or video billboards, when a pixel is intended to be off, small leakage currents and/or capacitive discharging can cause the pixel to continue glowing. These video displays typically turn the LEDs (pixels) ON-OFF at very high rates (PWM) to achieve an apparent variation in brightness. Leakage current and/or capacitive discharging becomes a problem in night viewing, for example, when one pixel is driven at a low brightness level (i.e., the pixel is "sort of OFF") and an adjacent pixel is turned "completely OFF". In this case, capacitive discharging can cause the "completely OFF" pixel to continue to glow for an undesirable period after the drive voltage is terminated, and the leakage current can cause the completely OFF pixel to appear to be lit at all times. That is, the light contrast between sort-of OFF and completely OFF pixels is reduced or completely lost due to capacitive discharging and leakage current. Another example involves emergency lighting, where leakage currents can cause LEDs to glow enough that in low light situations the emergency lights may appear to be ON.

The leakage/emission problem summarized above most affects LED drivers designed around LDO and switching regulator topologies, but can be can also be found in linear or DC drive topologies as well. In these products small leakage currents passing through the switching or control transistor are considered to be inconsequential and in many cases may be unavoidable due to the characteristics of the semiconductor process and the applied voltages. One solution to the low on-current characteristic of LEDs would be to produce LED driver circuits that do not generate any appreciable leakage current. However, this goal would require special semiconductor processes or device designs that would increase production costs over LED driver circuits designed and produced using conventional processing methods.

Further, even if special fabrication processes were used to generate a "perfect" LED driver circuit (i.e., an LED driver circuit exhibiting zero leakage current), undesirable current may still be caused, for example, by impurities on the PC board supporting the LED chain. That is, even if a perfect, non-leaking driver IC is produced, if the user's assembly process leaves residue on the display board that allows a leakage current to flow through the LEDS, the LEDs can appear to be turned on when they are intended to be turned off.

What is needed is a LED driver circuit that avoids the current/emission problems associated with conventional LED driver circuits.

SUMMARY OF THE INVENTION

The present invention is directed to a LED driver circuit including a shunt circuit that is connected between output and feedback terminals (i.e., to opposite ends of an externally connected LED or strings of LEDs), wherein the shunt circuit is selectively controlled to shunt leakage current around the LED/LEDs when a user applied control signal is disabled, thereby maintaining comparatively low voltages across the LEDs that preclude undesirable light emission. That is, when an applied drive current is turned off to the LED(s), the shunt circuit is activated to cause the two voltages applied to the respective terminals of the LED(s) (i.e., $V_{OUT}$ and $V_{LIMIT}$) to have same voltage level, which guarantees that the voltage across the LED(s) is close to zero, and much less than the voltage required to turn the LED on. By utilizing a standard transistor (and/or other circuit elements) to facilitate the desired shunting function, the present invention overcomes problems associated with conventional LED driver circuits without requiring special semiconductor processing techniques, and regardless of any impurities that may exist on the display PC board. The shunt switch has the added benefit of rapidly discharging any external capacitance that may be present across the LED(s), thereby turning off the LED(s) in a shorter amount of time than is possible using conventional methods.

BRIEF DESCRIPTION OF THE DRAWINGS

These and other features, aspects and advantages of the present invention will become better understood with regard to the following description, appended claims, and accompanying drawings, where:

DETAILED DESCRIPTION OF THE DRAWINGS

The present invention relates to an improvement in LED displays. The following description is presented to enable one of ordinary skill in the art to make and use the invention as provided in the context of a particular application and its requirements. The terms "coupled" and "connected", which are utilized herein, are defined as follows. The term "connected" is used to describe a direct connection between two circuit elements, for example, by way of a metal line formed in accordance with normal integrated circuit fabrication techniques. In contrast, the term "coupled" is used to describe either a direct connection or an indirect connection between two circuit elements. For example, two coupled elements may be directly connected by way of a metal line, or indirectly connected by way of an intervening circuit element (e.g., a capacitor, resistor, inductor, or by way of the source/drain terminals of a transistor). Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Figure 1:
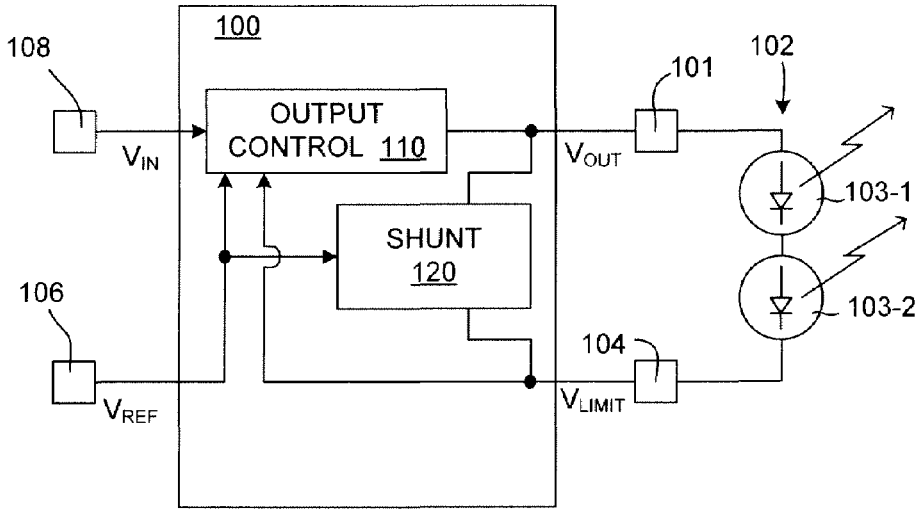
FIG. 1 is a simplified circuit diagram showing a LED driver circuit according to a generalized embodiment of the present invention.

FIG. 1 is a simplified circuit diagram showing a LED driver circuit 100 for generating an output voltage $V_{OUT}$ at an output terminal 101 that is used to control the amount of light generated by an LED chain 102 including serially connected LEDs 103-1 and 103-2 according to a generalized embodiment of the present invention. In accordance with conventional techniques, at least a portion of the signal generated at the cathodes of LED chain 102 is fed-back to LED driver circuit 100 by way of a feedback terminal 104. A user supplied reference (control) signal $V_{REF}$ is applied to a control (enable) input terminal 106 of driver circuit 100, and a system voltage $V_{IN}$ is supplied to a power terminal 108 of LED driver circuit 100. An output control circuit 110 passes a portion of system voltage $V_{IN}$ to generate output voltage $V_{OUT}$ in accordance with a predetermined relationship between control signal $V_{REF}$ and said feedback signal $V_{LIMIT}$. That is, when control signal $V_{REF}$ has a first predetermined voltage level (e.g., 1V) or higher, output control circuit 110 generates output voltage $V_{OUT}$ at a corresponding voltage level (e.g., 2V) that produces sufficient current to cause LEDs 103-1 and 103-2 to generate a corresponding amount of visible light. Conversely, when control signal $V_{REF}$ has a second predetermined voltage level (e.g., 0V), output control circuit 110 generates output voltage $V_{OUT}$ at a low voltage level. In accordance with alternative embodiments, output control circuit 110 is implemented using any LED driver topologies, such as low drop out (LDO), switching regulator, linear or DC drive topologies.

In accordance with the present invention, LED driver circuit 100 further includes a shunt circuit 120 that functions to couple output terminal 101 and feedback terminal 104 when control signal $V_{REF}$ has the second predetermined voltage level (i.e., when the intent of control signal $V_{REF}$ is to turn off LEDs 103-1 and 103-2). By fabricating output control circuit 110 and shunt circuit 120 utilizing standard electronic components (e.g., CMOS transistors and/or other circuit elements) to facilitate the desired output control and shunting functions, LED driver circuit 100 overcomes problems associated with conventional LED driver circuits without requiring special semiconductor processing techniques, and regardless of any impurities that may exist on a display PC board hosting LEDs 103-1 and 103-2.

Figure 2:
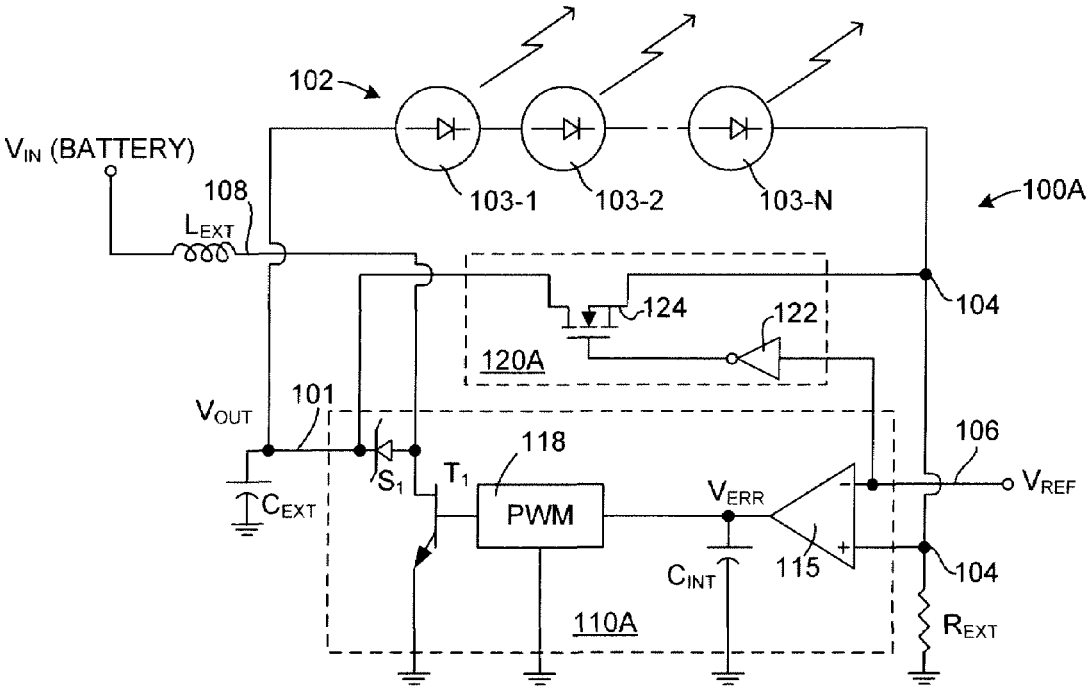
FIG. 2 is a simplified circuit diagram showing a LED driver circuit according to a specific embodiment of the present invention.

FIG. 2 is a simplified circuit diagram showing a LED driver circuit 100A including an output circuit 110A and a shunt circuit 120A according to a specific embodiment of the present invention. For explanatory purposes, output circuit 110A is similar to that described above with reference to conventional LED driver circuit 50. That is, output circuit 110 includes a DC-DC boost converter made up of a comparator (operational amplifier) 115, a pulse width modulator ("PWM") 118, an internal capacitor $C_{INT}$, an npn bipolar transistor $T_1$ and a zener diode $S_1$ that are utilized in conjunction with a passive inductor $L_{EXT}$ and a passive discharge capacitor $C_{EXT}$ to generate output voltage $V_{OUT}$ the manner described above with reference to conventional LED drive circuit 50. Those skilled in the art will recognize that many types of LED driver circuits may be modified in accordance with the present invention to achieve the shunting function described herein. As such, the present invention is not intended to be limited by output circuit 110A unless specified in the appended claims.

In accordance with the specific embodiment shown in FIG. 2, shunt circuit 120A includes an inverter 122 and an N-channel Field Effect Transistor (FET) 124. Inverter 122 has an input terminal connected to receive control signal $V_{REF}$ (i.e., connected to input terminal 106), and FET 124 has a first terminal connected to output terminal 101, a second terminal connected to the feedback terminal 104, and a gate (control) terminal connected to the output terminal of inverter 122.

During operation, while the control signal $V_{REF}$ remains relatively high, inverter 122 generates a low output signal that turns off (opens) FET 124, thereby preventing any current from flowing between output terminal 101 and feedback terminal 104. In this operating state, the relatively high control voltage $V_{REF}$ causes error amplifier 115, PWM 118, internal capacitor $C_{INT}$, transistor $T_1$ and diode $S_1$ to generate output voltage $V_{OUT}$ across LEDs 103-1 and 103-2 such that LEDs 103-1 and 103-2 generate visible light.

Conversely, when control signal $V_{REF}$ drops below a predetermined threshold voltage level, inverter 122 generates a high output signal that turns on (closes) FET 124, thereby shunting output voltage $V_{OUT}$ from output terminal 101 to feedback terminal 104 (i.e., such that output voltage $V_{OUT}$ substantially equals feedback voltage $V_{LIMIT}$, or differs by an amount that is less than that required to cause LEDs 103-1 and

103-2 to generate visible light). That is, any leakage current generated at output terminal 101 of driver circuit 100A is shunted around LEDs 103-1 and 103-2, preventing them from generating visible light.

Those skilled in the art will recognize that many different switch circuits may be used to implement shunt circuit 120A in accordance with the present invention to achieve the shunting function described herein. As such, the present invention is not intended to be limited by the specific circuit arrangement of LED driver circuit 100A unless specified in the appended claim.

LED driver circuit 100A provides several advantages over conventional LED driver circuits. First, LED driver circuit 100A solves the low on-current characteristic of newer LEDs using circuitry that can be produced using standard processing methods (e.g., inverter 122 and FET 124 are "standard" CMOS devices), thereby avoiding the need for special semiconductor processes or device designs that would increase production costs. The shunting operation also provides the added benefit of rapidly discharging any external capacitors (e.g., capacitor $C_{EXT}$, see FIG. 2), thus avoiding the capacitive discharge problem (mentioned above) that is associated with conventional LED drivers and facilitating faster turn-off speeds for the LEDs 103-1 and 103-2. Further, by coupling the output and feedback terminals, the two voltages (i.e., $V_{OUT}$ and $V_{LIMIT}$) applied to the respective terminals of LEDs 103-1 and 103-2 are caused to have the same voltage, which guarantees that the voltage across each LED is close to zero, even in the event of current caused by impurities on the display PCB hosting LEDs 103-1 to 103-N.

Figure 3:
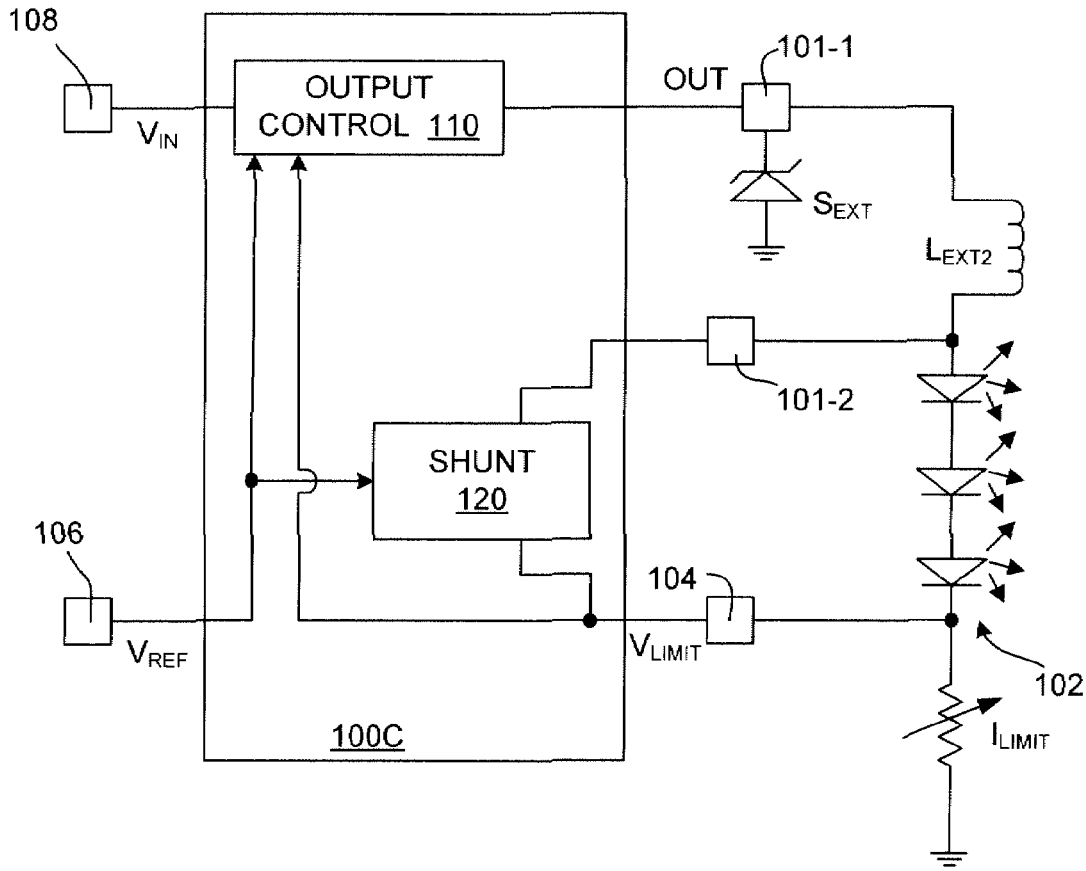
FIG. 3 is simplified circuit diagram showing a LED driver circuit according to a generalized embodiment of the present invention.
Figure 4:
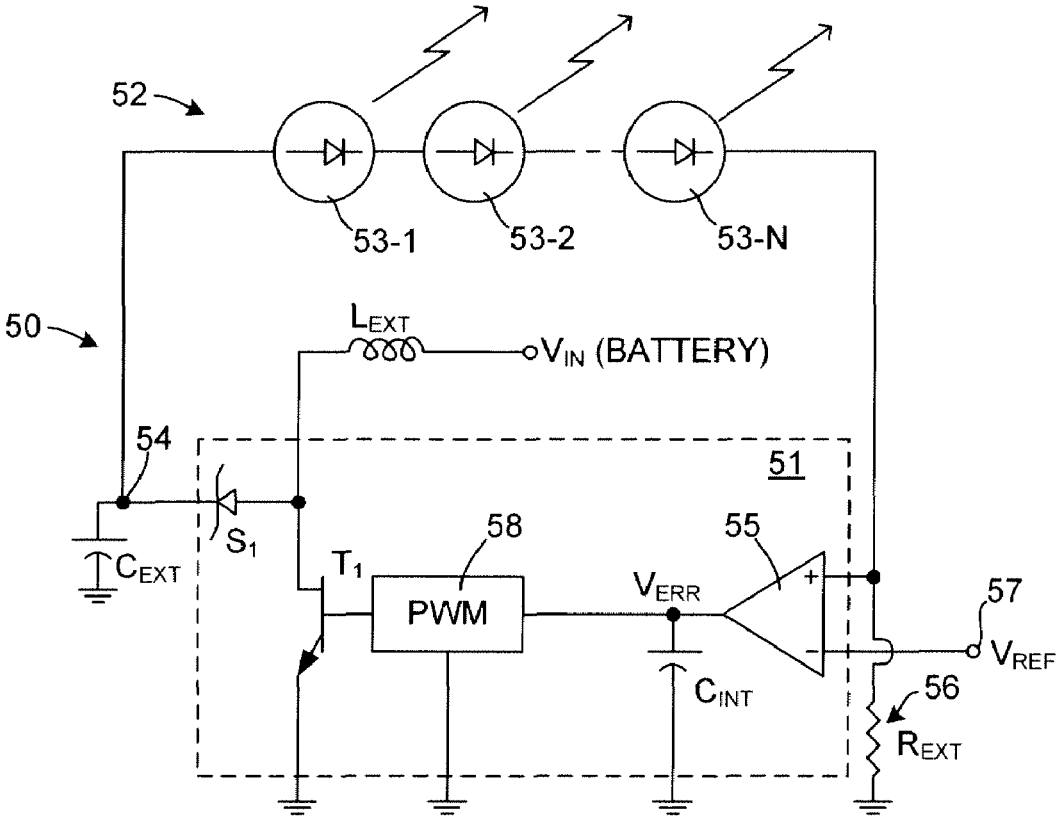
FIG. 4 (PRIOR ART)
FIG. 4 is simplified circuit diagram showing a conventional LED driver circuit.

FIG. 3 is a simplified circuit diagram showing a LED driver circuit 100C according to another alternative embodiment of the present invention. LED driver circuit 100C is substantially identical to the embodiment described above with reference to FIG. 1, but includes a separate output terminal 101-1 and shunt control terminal 101-2 to facilitate coupling external inductor $L_{EXT2}$ and external zener diode $S_{EXT}$ between output control circuit 110 and LED chain 102. Note that, when enabled, shunt circuit 120 effectively couples output terminal 101-1 to feedback terminal 104 by way of inductor $L_{EXT2}$.

Although the present invention has been described with respect to certain specific embodiments, it will be clear to those skilled in the art that the inventive features of the present invention are applicable to other embodiments as well, all of which are intended to fall within the scope of the present invention. For example, it will be recognized by those skilled in the art that the methodology can be used to drive a single LED, or extended to a plurality of banks of LEDs of a variety of commercially available types and sizes.

The invention claimed is:

1. A LED driver circuit for controlling the amount of light generated by one or more serially connected Light-Emitting Diodes (LEDs), comprising:

an output terminal for supplying an output voltage to the one or more serially connected LEDs;

a feedback terminal for receiving a feedback signal from the one or more serially connected LEDs;

an input terminal for receiving a control signal;

output means for generating said output voltage in accordance with a predetermined relationship between said control signal and said feedback signal when said control signal has a first predetermined voltage level, whereby said one or more serially connected LEDs are driven to generate visible light, and shunt means for coupling said output terminal to said feedback terminal when said control signal has a second predetermined voltage level, whereby said output terminal and said feedback terminal are maintained at a substantially common voltage.

2. The LED driver of claim 1, wherein the shunt means comprises a transistor having a first terminal coupled to the output terminal, a second terminal coupled to the feedback terminal, and a control terminal coupled to the input terminal.

3. The LED driver of claim 2, wherein the transistor comprises an enhancement mode transistor, and wherein the shunt means further comprises an inverter connected between the input terminal and the control terminal of the enhancement mode transistor.

4. The LED driver of claim 1, wherein the output means comprises one of a low drop out (LDO), switching regulator, linear and DC drive topology.

5. A LED driver circuit for controlling the amount of light generated by one or more serially connected Light-Emitting Diodes (LEDs), comprising:

an output terminal for supplying an output voltage to the one or more serially connected LEDs;

a feedback terminal for receiving a feedback signal from the one or more serially connected LEDs;

an input terminal for receiving a control signal;

an output circuit including means for generating said output voltage in accordance with a predetermined relationship between said control signal and said feedback signal when said control signal has a first predetermined voltage level, whereby said one or more serially connected LEDs are driven to generate visible light, and a shunt circuit including a transistor having a first terminal coupled to the output terminal, a second terminal coupled to the feedback terminal, and a control terminal coupled to the input terminal.

6. The LED driver of claim 5, wherein the transistor comprises an enhancement mode transistor, and wherein the shunt means further comprises an inverter connected between the input terminal and the control terminal of the enhancement mode transistor.

7. The LED driver of claim 5, wherein the output circuit comprises one of a low drop out (LDO), switching regulator, linear and DC drive topology.

8. An LED display comprising:

one or more serially connected Light-Emitting Diodes (LEDs); and an LED driver circuit for controlling the amount of light generated by said one or more LEDs, the LED driver circuit comprising:

an output terminal for supplying an output voltage to the one or more serially connected LEDs;

a feedback terminal for receiving a feedback signal from the one or more serially connected LEDs;

an input terminal for receiving a control signal;

output means for generating said output voltage in accordance with a predetermined relationship between said control signal and said feedback signal when said control signal has a first predetermined voltage level, whereby said one or more serially connected LEDs are driven to generate visible light, and shunt means for coupling said output terminal to said feedback terminal when said control signal has a second predetermined voltage level, whereby said output terminal and said feedback terminal are maintained at a substantially common voltage.

9. The LED display of claim 8, wherein the shunt means comprises a transistor having a first terminal coupled to the output terminal, a second terminal coupled to the feedback terminal, and a control terminal coupled to the input terminal.

10. The LED display of claim 9, wherein the transistor comprises an enhancement mode transistor, and wherein the shunt means further comprises an inverter connected between the input terminal and the control terminal of the enhancement mode transistor.

11. The LED driver of claim 8, wherein the output means comprises one of a low drop out (LDO), switching regulator, linear and DC drive topology.

* * * * *